US009914116B2

(12) United States Patent
Hishida et al.

(10) Patent No.: US 9,914,116 B2
(45) Date of Patent: Mar. 13, 2018

(54) MICROELEMENT

(71) Applicant: Panasonic Intellectual Property Management Co., Ltd., Osaka (JP)

(72) Inventors: Mitsuoki Hishida, Osaka (JP); Makoto Iyoda, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 107 days.

(21) Appl. No.: 15/208,795

(22) Filed: Jul. 13, 2016

(65) Prior Publication Data

US 2017/0073212 A1 Mar. 16, 2017

(30) Foreign Application Priority Data

Sep. 10, 2015 (JP) ..... 2015-178763

(51) Int. Cl.
*B01L 3/00* (2006.01)

(52) U.S. Cl.
CPC ..... *B01L 3/00* (2013.01)

(58) Field of Classification Search
CPC ..... B01L 3/00; Y10T 137/218
USPC ..... 137/825
See application file for complete search history.

(56) References Cited

U.S. PATENT DOCUMENTS 4,581,624 A * 4/1986 O'Connor ..... F15C 5/00 137/831
4,647,013 A * 3/1987 Giachino ..... B41J 2/17596 239/102.2
4,826,131 A * 5/1989 Mikkor ..... F02M 61/1853 239/585.3
5,029,805 A * 7/1991 Albarda ..... B41J 2/17596 251/11
7,328,882 B2 * 2/2008 Wang ..... F15C 5/00 251/129.01
8,235,073 B2 * 8/2012 Namkoong ..... B01L 3/502738 137/828

FOREIGN PATENT DOCUMENTS

WO 2001/066947 9/2001

* cited by examiner

*Primary Examiner* — Eric Keasel
(74) *Attorney, Agent, or Firm* — McDermott Will & Emery LLP

(57) ABSTRACT

A microelement includes: a base being a body of the microelement, the base including a liquid inlet for a liquid to be introduced, a liquid outlet for the liquid to be discharged, and a groove for the liquid to flow from the liquid inlet toward the liquid outlet; a cover that covers the groove of the base; and a liquid flow controller film segment that is fixed to an inner surface of the cover so as to be opposite to the groove. The liquid flow controller film segment is arc-shaped curved-band-like extending in a direction crossing a flow direction of the liquid and has a radius about a center-corresponding position of the cover corresponding to a center of the liquid outlet of the groove. The liquid flow controller film segment is exposed in the groove and disposed on the downstream side to an exposed surface at the inner surface of the cover in the flow direction of the liquid in the groove. The liquid flow controller film segment has a contact angle that is greater than a contact angle of the exposed surface at the inner surface of the cover.

6 Claims, 20 Drawing Sheets

MICROELEMENT

BACKGROUND

1. Technical Field

The present disclosure relates to a microelement such as a microdevice or a microchip for handling a liquid of several microliters to several hundred microliters per second.

2. Description of the Related Art

As to a microelement such as a microdevice or a microchip for handling a liquid of several microliters to several hundred microliters per second, miniaturization of an apparatus appropriate to an amount of a liquid to be conveyed and a reduction in costs are desired. Conventionally, in a microdevice or a microchip, a channel for allowing a liquid to flow or a chamber for storing a liquid is structured by two or more components being bonded to each other and sealed except for portions forming an inlet and outlet of the liquid, so as to prevent leakage of the handled liquid.

A single or a plurality of chambers are provided in a microdevice or a microchip. The chambers are coupled to each other by at least one channel, to form the microdevice or the microchip (see PTL 1).

CITATION LIST

Patent Literature

PTL 1: WO2001-066947 (Japanese Patent Application No. 2001-565533)

When a liquid is introduced into a chamber of a microdevice or a microchip from an inlet such as a hole through use of a pump, the advancement route of the liquid with which the chamber is to be filled may vary depending on locations in the chamber due to the internal shape of the chamber, projections, capillarity or the like. In this case, when the liquid arrives at the outlet before the chamber is completely filled with the liquid, the liquid is discharged from the outlet leaving the chamber unfilled with the liquid. In this case, the space in the chamber unfilled with the liquid is an air bubble, which stays as it is. Even when extra liquid is introduced from the inlet in order to discharge the remaining liquid, in most cases, the liquid keeps flowing out from the outlet and the air bubble remains. The air bubble staying inside the chamber varies the amount of the liquid in the chamber. Thus, disadvantageously, the liquid cannot be supplied by a stable amount.

SUMMARY

One non-limiting and exemplary embodiment provides a microelement with which a liquid can be supplied by a stable amount.

In order to achieve the object, the present disclosure is structured as follows.

In one general aspect, the techniques disclosed here feature a microelement including:

a base being a body of the microelement, the base including a liquid inlet for a liquid to be introduced, a liquid outlet for the liquid to be discharged, and a groove for the liquid to flow from the liquid inlet toward the liquid outlet;

a cover that covers the groove of the base; and a film that is fixed to an inner surface of the cover so as to be opposite to the groove, wherein the film includes a liquid flow controller film segment whose width is identical to a width of the groove in a direction crossing a flow direction of the liquid as seen from a thickness direction of the base, the liquid flow controller film segment is disposed to be exposed in the groove, the liquid flow controller film segment is arc-shaped curved-band-like and has a radius about a center-corresponding position of the cover corresponding to a center of the liquid outlet of the groove, the liquid flow controller film segment is positioned on a downstream side to an exposed surface at the inner surface of the cover in the flow direction of the liquid in the groove, and the liquid flow controller film segment has a contact angle that is greater than a contact angle of the exposed surface at the inner surface of the cover.

According to the aspect of the present disclosure, even in the situation where flows of rushing liquid on the opposite sides in the width direction of the liquid which is introduced from the liquid inlet and with which the groove is filled are initially preceding the main-flow liquid toward the liquid outlet, the film segment can exert the restraining force to align the leading end of the liquid. Thus, advancement of the liquid and the portion to be filled can be controlled, whereby any air bubble can be restrained from remaining in the groove.

DETAILED DESCRIPTION

Figure 1A:
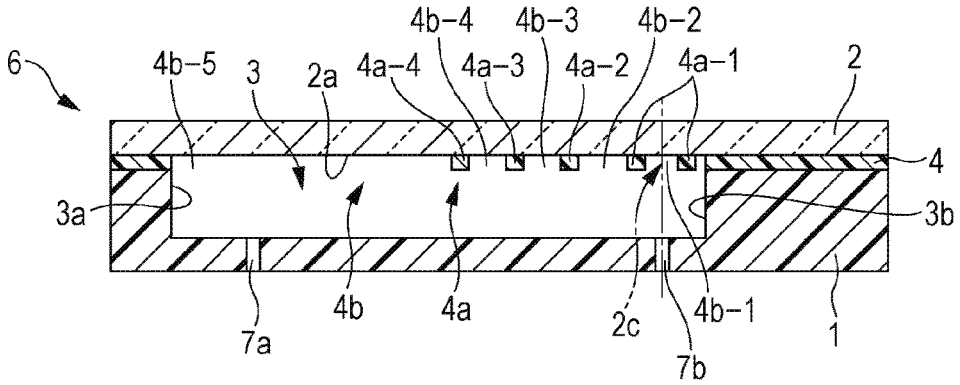
FIG. 1A is a side cross-sectional view of a chamber of a microchip according to a first exemplary embodiment of the present disclosure.

In the following, a detailed description will be given of exemplary embodiments of the present disclosure with reference to the drawings.

Prior to the detailed description of the exemplary embodiments of the present disclosure with reference to the drawings, various aspects of the present disclosure are described hereinafter.

A first aspect of the present disclosure provides a microelement including:

a base being a body of the microelement, the base including a liquid inlet for a liquid to be introduced, a liquid outlet for the liquid to be discharged, and a groove for the liquid to flow from the liquid inlet toward the liquid outlet;

a cover that covers the groove of the base; and a film that is fixed to an inner surface of the cover so as to be opposite to the groove, wherein the film includes a liquid flow controller film segment whose width is identical to a width of the groove in a direction crossing a flow direction of the liquid as seen from a thickness direction of the base, the liquid flow controller film segment is disposed to be exposed in the groove, the liquid flow controller film segment is arc-shaped curved-band-like and has a radius about a center-corresponding position of the cover corresponding to a center of the liquid outlet of the groove, the liquid flow controller film segment is positioned on a downstream side to an exposed surface at the inner surface of the cover in the flow direction of the liquid in the groove, and the liquid flow controller film segment has a contact angle that is greater than a contact angle of the exposed surface at the inner surface of the cover.

According to the aspect, even in the situation where flows of rushing liquid on the opposite sides in the width direction of the liquid which is introduced from the liquid inlet and with which the groove is filled are initially preceding the main-flow liquid toward the liquid outlet, the film segment can exert the restraining force to align the leading end of the liquid. Thus, advancement of the liquid and the portion to be filled can be controlled, whereby any air bubble can be restrained from remaining in the groove.

A second aspect of the present disclosure provides the microelement according to the first aspect, wherein a difference between the contact angle of the liquid flow controller film segment and the contact angle of the exposed surface at the inner surface of the cover is at least 20 degrees.

According to the aspect, when the difference between the contact angle of the liquid flow controller film segment and the contact angle of the exposed surface at the inner surface of the cover is at least 20 degrees, the rush-delaying force (pulling-back force) produced by an increase in the contact angle at the boundary of materials different from each other relative to the flow direction of the liquid can surely act on the liquid based on the difference in the contact angle. Thus, the advance of the preceding liquid due to capillarity can be delayed.

A third aspect of the present disclosure provides the microelement according to one of the first and second aspects, wherein the liquid flow controller film segment has a thickness of 5 nm to 14 μm inclusive.

According to the aspect, the liquid flow controller film segment can be manufactured as a uniform film when the thickness thereof is 5 nm or more. When the thickness of the liquid flow controller film segment is 14 μm or less, the liquid is always brought into contact with the inner surface of the cover, and the restrain control function by the difference in the contact angle can be exhibited.

A fourth aspect of the present disclosure provides the microelement according to any one of the first to third aspects, wherein the liquid flow controller film segment is an arc-band-like film segment positioned near the liquid outlet, and a minimum distance between the liquid outlet and the arc-band-like film segment is greater than a minimum distance between the liquid outlet and a curved back end wall of the groove near the liquid outlet.

According to the aspect, after the leading end of the liquid is surely aligned by the arc-band-like film segment near the liquid outlet, the liquid surely surrounds the liquid outlet along the curved back end wall of the groove. Thus, any air bubble in the groove can be entirely expelled.

A fifth aspect of the present disclosure provides microelement according to any one of the first to fourth aspects, wherein the liquid flow controller film segment has a slit extending in the flow direction of the liquid.

According to the aspect, the slit portion can achieve the effect similar to that achieved by the liquid flow controller film segment.

In the following, a specific description will be given of exemplary embodiments of the present disclosure with reference to the drawings.

First Exemplary Embodiment

Figure 1B:
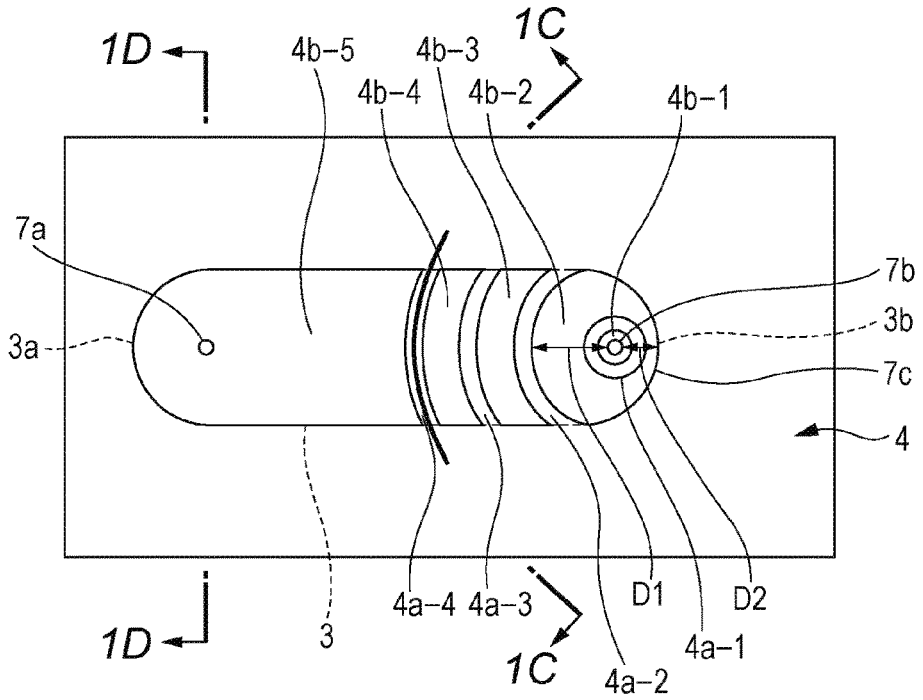
FIG. 1B is a plan view, as seen from above, of the chamber of the microchip according to the first exemplary embodiment of the present disclosure.
Figure 1C:
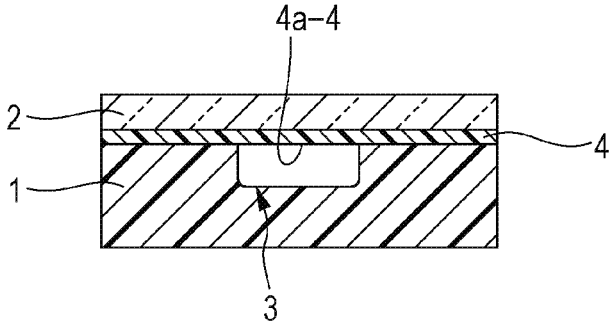
FIG. 1C is a cross-sectional view taken along line 1C-1C in FIG. 1B.
Figure 1D:
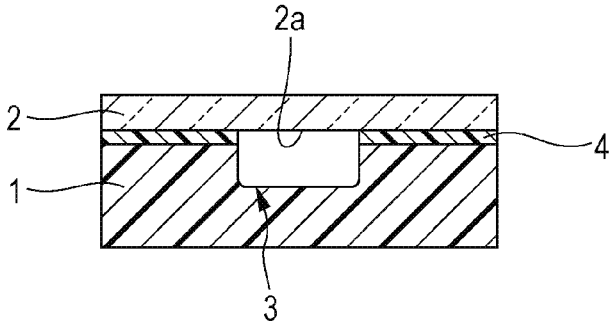
FIG. 1D is a cross-sectional view taken along line 1D-1D in FIG. 1B.

FIGS. 1A and 1B are respectively a side cross-sectional view of a chamber of a microchip according to a first exemplary embodiment of the present disclosure, and a plan view thereof as seen from above in the state where a cover is removed. FIG. 10 is a cross-sectional view taken along line 10-10 in FIG. 1B. FIG. 1D is a cross-sectional view taken along line 1D-1D in FIG. 1B.

Figure 1E:
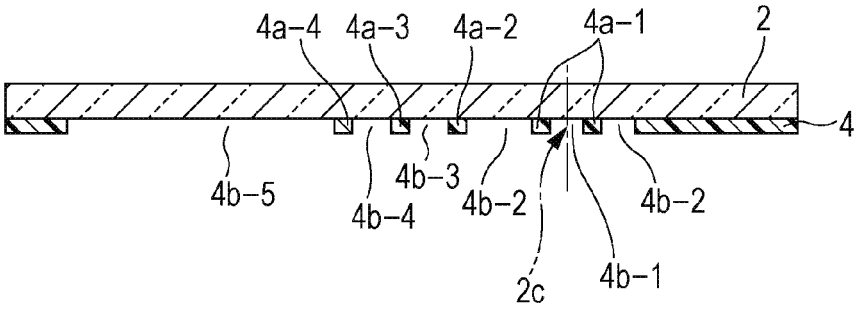
FIG. 1E is a side cross-sectional view of a cover that covers the chamber of the microchip.
Figure 1F:
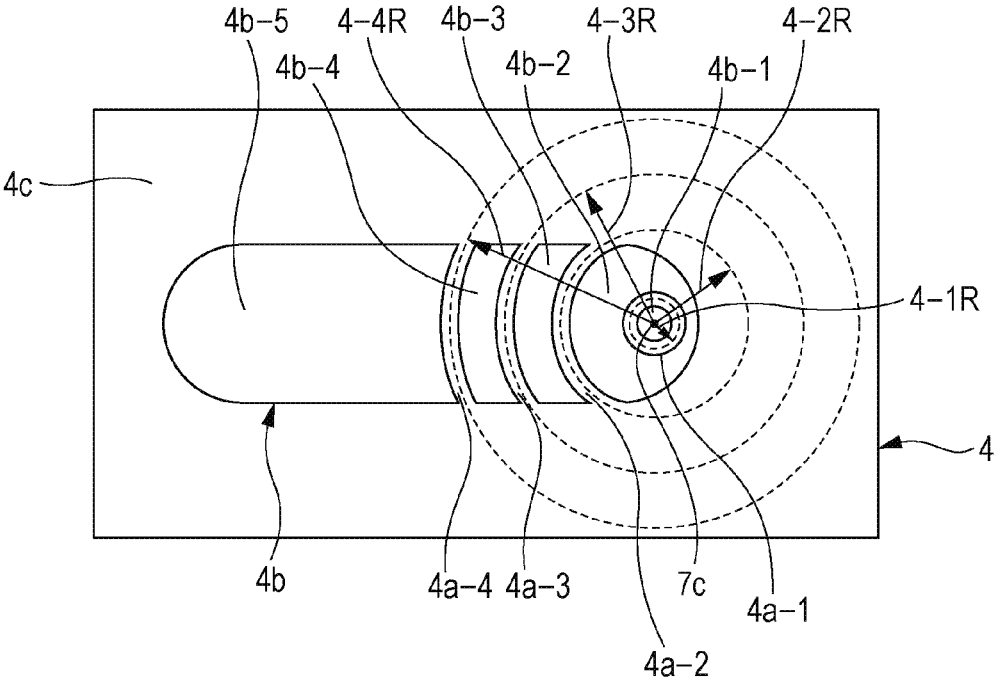
FIG. 1F is a plan view of a film of the microchip.

FIGS. 1E and 1F are respectively a side cross-sectional view of the cover that covers a chamber of the microchip according to the first exemplary embodiment of the present disclosure, and a plan view of a film.

As shown in FIGS. 1A to 1F, microchip 6 includes base 1, cover 2, and film segments (in other words, liquid flow controller film segments) 4*a*-1, 4*a*-2, 4*a*-3, 4*a*-4.

The liquid flow controller film segment may be referred to as a belt. More specifically, the film segments 4*a*-1, 4*a*-2, 4*a*-3, and 4*a*-4 shown in FIG. 1A-FIG. 1F may be referred to as a first belt, a second belt, a third belt, and a fourth belt.

Base 1 is made of silicon, for example. For example, on the upper surface of rectangular-plate-like base 1, groove 3 that functions as a chamber or a channel is formed in the longitudinal direction. As shown in FIG. 1B, an example of groove 3 is a rectangular recess that extends at the central portion. The shape of groove 3 is not limited thereto, and groove 3 may be in any shape. Near one of the curved ends of groove 3 (for example, near the left end in FIGS. 1A and 1B), liquid inlet 7*a* is bored. Hereinafter, the liquid inlet 7*a* is referred to just as an "inlet 7*a*". Near the other one of the curved ends of groove 3 (for example, near the right end in FIGS. 1A and 1B), liquid outlet 7*b* is bored. Hereinafter, the liquid outlet 7*b* is referred to just as an "outlet 7*b*". As one example, groove 3 has a constant depth. Since the width of liquid outlet 7*b* is smaller than the width of groove 3, when liquid 5 surround liquid outlet 7*b* nearby, air bubble 8 tends to be left. The exemplary embodiments of the present specification address thereto.

The opposite ends of groove 3 are curved. Specifically, front end wall 3*a* near liquid inlet 7*a* (for example, the arc-shaped left end wall in FIG. 1B) is curved, and back end wall 3*b* near liquid outlet 7*b* (for example, the arc-shaped right end wall in FIG. 1B) is also curved.

Cover 2 is bonded and fixed onto base 1, whereby the entire upper surface of base 1 including groove 3 is covered by cover 2. Cover 2 is formed of rectangular plate-like glass, for example. As just described, the cover 2 is disposed opposite to the plate-like base 1. Hence, microchip 6 is sealed so as to prevent leakage of liquid 5 to the outside of microchip 6, and just allows liquid 5 to flow from liquid inlet 7*a* toward liquid outlet 7*b* in a space formed between groove 3 and inner surface 2*a* which is the lower surface of cover 2. In other words, the cover has an inward surface 2*a* and an outward surface. The inward surface is opposite to the plate-like base 1 (namely, to the bottom surface of the groove 3

Film 4 is fixed to inner surface 2*a* of cover 2 so as to be opposite to groove 3, and has a plurality of film segments 4*a*. The material of film 4 is different from that of inner surface 2*a* of cover 2. The material of film 4 may be a nitride, an oxide, or an organic substance. The nitride may be, for example, a-SiN:H, $Si_3N_4$, or SiON. The oxide may be $SnO_2$, ZnO, $In_2O_3$, $Fe_3O_4$, $Fe_2O_3$, $Fe_2TiO_3$, NiO, CuO, $Cu_2O$, $TiO_2$, $SiO_2$, $In_2O_3$, or $WO_3$. An exemplary organic film may be polytetrafluoroethylene (PTFE), polyvinylidene difluoride (PVDF), polypropylene (PP), polyethylene (PE), or polysulfone (PS). As shown in FIGS. 1B and 1F, for example, film 4 includes arc-band-like thin film segments 4*a*, i.e., 4*a*-1, 4*a*-2, 4*a*-3, 4*a*-4, that extend in the groove width direction relative to through holes 4*b*, which are as a whole approximately elliptical and correspond to groove 3. The center of curvature of each of film segments 4*a*-1, 4*a*-2, 4*a*-3, 4*a*-4 is the center of liquid outlet 7*b*. At through holes 4*b*, i.e., 4*b*-1, 4*b*-2, 4*b*-3, 4*b*-4, 4*b*-5, formed by film segments 4*a*-1, 4*a*-2, 4*a*-3, 4*a*-4, inner surface 2*a* of cover 2 is exposed as exposed surfaces. Hence, liquid flow controller film segments 4*a* are positioned on the downstream side of the exposed surfaces at inner surface 2*a* of cover 2 with respect to the liquid flow direction. The tangent direction at the curved portion of each of through holes 4*b* and film segments 4*a* crosses the direction in which liquid 5 flows. FIG. 1C shows a vertical cross-section taken along curved line 1C-1C that passes, for example, film segment 4*a*-4 in FIG. 1B. FIG. 1C shows the state where film segment 4*a*-4 projects into groove 3 and liquid 5 can be brought into contact with film segment 4*a*-4 in groove 3. FIG. 1D is a cross-sectional view taken along line 1D-1D in FIG. 1B. FIG. 1D shows a vertical cross-section taken along line 1D-1D that passes through holes 4*b*, and no film segments 4*a* are shown. In FIG. 1D, no film segments 4*a* exist in groove 3, and liquid 5 can be brought into contact with the exposed surface of inner surface 2*a* of cover 2 inside groove 3.

As just described, each of the belts 4*a* is provided on the inward surface 2*a* so as to protrude from the inward surface 2*a*) Each of the belts 4*a* has a thickness parallel to the thickness direction of the plate-like base 1. Each of the belts 4*a* has a shape of a minor arc. The minor arc means an arc having a center angle less than 180 degrees.

The length of film segments 4*a* and through holes 4*b* (the dimension in the top-bottom direction in FIG. 1B) is identical to the width of groove 3 (the dimension in the top-bottom direction in FIG. 1B) so as to prevent a reduction in a restrain control function achieved by the difference in the contact angle θ, which will be described later. More specifically, the length of film segments 4*a* is identical to the width of groove 3 in the direction crossing the flow direction of liquid 5, as seen from the thickness direction of base 1.

Further, film segments 4*a* have a thickness of 5 nm to 14 μm inclusive. It is difficult to manufacture uniform film 4 whose thickness is less than 5 nm. With film 4 whose thickness is greater than 14 m, liquid 5 is not brought into contact with the exposed surfaces at inner surface 2*a* of cover 2, and the restrain control function achieved by the difference in the contact angle θ, which will be described later, reduces.

Further, minimum distance D1 between liquid outlet 7*b* and arc-band-like film segment 4*a*-2 nearest to liquid outlet 7*b* is greater than minimum distance D2 between liquid outlet 7*b* and curved back end wall 3*b* of groove 3 near liquid outlet 7*b*. As just described, a backend wall 3*b* is located at an end of the groove 3 at a side of the outlet 7*b*. The radius 4-1R (namely, distance D2) of the arc of the first belt 4*a* is larger than the distance D1 between the outlet 7 and the backend wall 3*b*. Such a structure prevents liquid 5 from entering liquid outlet 7*b* before the leading end of liquid 5 is aligned by reaching arc-band-like film segment 4*a*-2. In other words, with such a structure, the leading end of liquid 5 is surely aligned by arc-band-like film segment 4*a*-2 nearest to liquid outlet 7*b*, and thereafter liquid 5 flows toward liquid outlet 7*b* and surely curves along curved back end wall 3*b* of groove 3. Thus, liquid 5 can expel the entire air bubble 8 in groove 3.

Further, the width of film segments 4*a* is greater than the depth of groove 3, and is equal to or smaller than half the distance between liquid inlet 7*a* and liquid outlet 7*b*. As a specific example, the width of film segments 4*a* ranges from 1 mm to 5 mm inclusive. The width is at least 1 mm so as to make allowance by being greater than the depth, because liquid 5 reaches cover 2 as diagonally lagging from groove 3 due to surface tension. Meanwhile, since the width must be limited to a certain extent for a plurality of arcs to be patterned, the maximum width is 5 mm.

An exemplary method for disposing film segments 4*a* at inner surface 2*a* of cover 2 may be as follows. Firstly, over the entire inner surface 2*a* of cover 2, film 4 being different in the contact angle from the exposed surface of inner surface 2*a* of cover 2 is formed to have a thickness of, for example, 15 μm. Thereafter, film 4 is patterned through a lithography process or the like, to leave arc-band-like, in other words, annular or arc-band-like thin film segments 4*a*. As shown in FIG. 1B, the patterning shapes are in an annular shape and arc-band-like shapes about center-corresponding position 2*c* of cover 2 corresponding to center 7*c* of liquid outlet 7*b*.

FIGS. 1B and 1F show annular film segment 4*a*-1 that has smallest radius 4-1R from center-corresponding position 2*c*. The radius or radius of curvature of annular film segment 4*a*-1 nearest to liquid outlet 7*b* is smaller than the radii or radii of curvature of other film segments 4*a*-2 to 4*a*-4. FIGS. 1B and 1F show also arc-shaped film segment 4*a*-2 that has greater radius 4-2R from center-corresponding position 2*c*. FIGS. 1B and 1F show also film segments 4*a*-3 patterned to have further greater radius 4-3R and film segment 4*a*-4 patterned to have still further greater radius 4-4R in order. Here, as to the positional relationship between base 1 and cover 2, base 1 side is the bottom side, and cover 2 side is the top side. Further, in an actual experiment, the annular or arc-band-like width (the dimension in the radius direction) of each of film segments 4*a*-1, 4*a*-2, 4*a*-3, 4*a*-4 is set to 1 mm, for example. Further, in FIG. 1F, film portion 4*c* except for groove 3 and being in contact with base 1 is kept intact.

As just described, each of the belts 4*a* has a shape of an minor arc, and the centers of the minor arcs is located at the outlet 7*b*. In other words, the centers of the minor arcs accord with the outlet 7*b* (in a strict sense, the center of the outlet 7*b*) in the top view. Therefore, the first-fourth belts 4*a*-1-4*a*-4 are concentric. The radius 4-1R of the first belt 4*a*-1 having a shape of a minor arc is smaller than the radius 4-2R of the second belt 4*a*-2. Similarly, the radius 4-2R of the second belt 4*a*-2 having a shape of a minor arc is smaller than the radius 4-3R of the third belt 4*a*-3. The radius 4-3R of the third belt 4*a*-3 having a shape of a minor arc is smaller than the radius 4-4R of the fourth belt 4*a*-4.

The shape of groove 3 is not limited to circular, and may be various shapes such as elliptical, triangular, and quadrangular depending on the intended use. Ideally, patterned film segments 4*a* have circular shapes whose radii become gradually greater relative to center 7*c* of liquid outlet 7*b*. However, when the radius of the circle becomes excessively great, the annular shape of film segments 4*a* may not be included in groove 3 and may become greater than groove 3. In this case, an arc-band-like shape is patterned in place of an annular shape. The arc-band-like shapes are patterned such that the film segments 4*a* are each positioned at a uniform distance to center 7*c* of liquid outlet 7*b*. Thus, the restraining force uniformly acts on the leading end of liquid 5 relative to liquid outlet 7*b*, and the leading end of liquid 5 can be aligned with the arc-shape. In this manner, when the leading end of liquid 5 is aligned with the arc-shape, liquid 5 reaching near liquid outlet 7*b* can flow from the opposite sides along curved back end wall 3*b* on the back side of liquid outlet 7*b*. Then, liquid 5 encloses air bubble 8 in groove 3, to smoothly expel air bubble 8 from liquid outlet 7*b*. Film 4 is left intact except for through holes 4*b* between film segments 4*a* oppositely provided to groove 3. Base 1 and cover 2 are bonded to each other with film 4 interposed therebetween, whereby microchip 6 is structured.

Hence, liquid 5 in groove 3 flows from liquid inlet 7*a* to liquid outlet 7*b* while being brought into contact with different materials, in order of the exposed surface at inner surface 2*a* of cover 2 at through hole 4*b*-5, film segment 4*a*-4, the exposed surface at inner surface 2*a* of cover 2 at through hole 4*b*-4, film segment 4*a*-3, the exposed surface at inner surface 2*a* of cover 2 at through hole 4*b*-3, film segment 4*a*-2, the exposed surface at inner surface 2*a* of cover 2 at through hole 4*b*-2, film segment 4*a*-1, and the exposed surface at inner surface 2*a* of cover 2 at through hole 4*b*-1.

Note that, through holes 4*b* for exposing the exposed surfaces at inner surface 2*a* of cover 2 and film segments 4*a* may each be provided at least one in number, because it just reduces the number of times of liquid 5 being brought into contact with film segments 4*a* differing in the contact angle. Film segments 4*a* may be at least annular film segment 4*a*-1 alone, or may be arc-band-like film segment 4*a*-2 alone. Even though there is an imponderable of liquid 5 hitting and returning from back end wall 3*b*, ultimately an air bubble is prevented from remaining. Therefore, in the case where a single film segment is provided, it is more effective to employ annular film segment 4*a*-1 alone than arc-band-like film segment 4*a*-2 alone.

Since inner surface 2*a* of cover 2 and film 4 are different from each other in the material, the exposed surface at inner surface 2*a* of cover 2 has greater contact angle θ2 than contact angle θ1 of film segments 4*a* of film 4. Hereinafter, the reason why materials being different from each other in the contact angles θ1, 02 are employed is detailed.

Figure 2A:
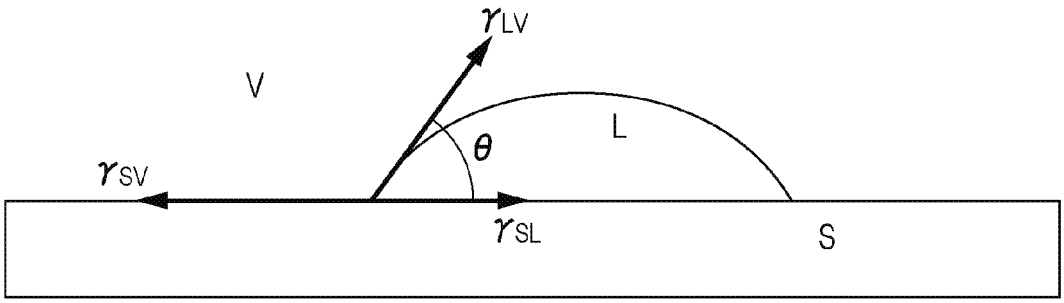
FIG. 2A is an explanatory diagram of the surface tension that acts on a liquid on the surface of a solid.

Firstly, as shown in FIG. 2A, contact angle θ is angle θ formed by drop 21*a* of liquid 21 and solid surface 22. According to Young's equation, the following is established:

surface tension $_{\gamma SV}$ of solid *S*=surface tension $_{\gamma SL}$ of solid *S* and liquid *L*+(surface tension $_{\gamma LV}$ of liquid $L\times_{cos}$ θ).

Figure 2B:
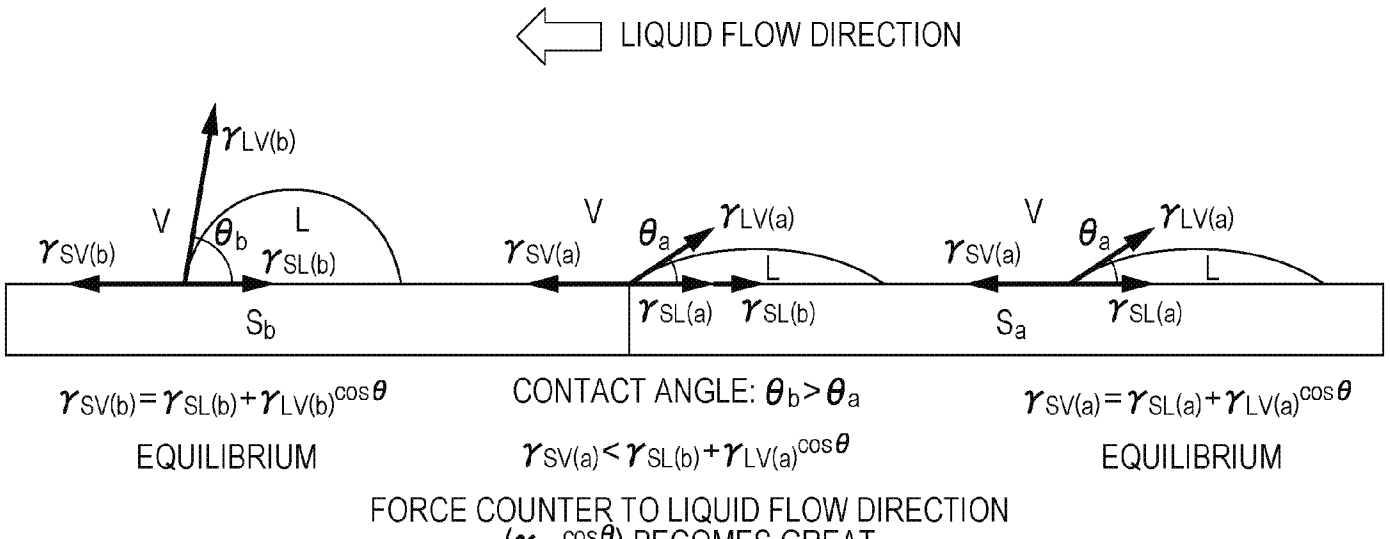
FIG. 2B is an explanatory diagram of the surface tension that acts on a liquid on the surface of a solid in the case where the liquid passes over materials that are different from each other in the contact angle.

Accordingly, as shown in FIG. 2B, a case where liquid L passes over materials differing from each other in the contact angle θ is discussed. When liquid L shifts from first solid Sa, which is a material with smaller contact angle θa, to second solid Sb, which is a material with greater contact angle θb, liquid L is subjected to just the surface tension acting on the material 25 with greater contact angle θb. That is, it is considered as follows.

Firstly, on first solid Sa, the following is established (see the right end portion in FIG. 2B):

surface tension $_{\gamma SV(a)}$ acting at the interface between first solid *Sa* and surrounding gas=surface tension $_{\gamma SL(a)}$ acting at the interface between first solid *Sa* and liquid *L*+(surface tension $_{\gamma LV(a)}$ acting at the interface between liquid *L* and surrounding gas on first solid $Sa\times_{cos}$ θ).

Next, on second solid Sb, the following is established (see the left end portion in FIG. 2B):

surface tension $_{\gamma SV(b)}$ acting at the interface between second solid *Sb* and surrounding gas=surface tension $_{\gamma SL(b)}$ acting at the interface between second solid *Sb* and liquid *L*+(surface tension $_{\gamma LV(b)}$ acting at the interface between liquid *L* and surrounding gas on second solid $Sb\times_{cos}$ θ).

At the boundary of first solid Sa and second solid Sb, the following is established (see the central portion in FIG. 2B):

surface tension $_{\gamma SV(a)}$ acting at the interface between first solid *Sa* and surrounding gas at the boundary=surface tension $_{\gamma SL(b)}$ acting at the interface between first solid *Sa* and liquid *L*+(surface tension $_{\gamma LV(a)}$ acting at the interface between liquid *L* and surrounding gas on second solid $Sb\times_{cos}$ θ).

That is, in the case where liquid L passes over first and second solids Sa, Sb made of materials with different contact angles θa, θb, respectively, when liquid L shifts from first solid Sa of the material with smaller contact angle θa to second solid Sb of the material with greater contact angle θb, liquid L is subjected to just surface tension $_{\gamma LV(b)}$ at second solid Sb of the material with greater contact angle θb, and not to surface tension $_{\gamma LV(a)}$ at first solid Sa of the material with smaller contact angle θa. Then, at the boundary of first and second solids Sa, Sb made of made of materials with different contact angles θa, θb, respectively, as force ($_{\gamma LV(b)}$) counter to the flow direction of liquid L, liquid L is subjected to surface tension $_{\gamma LV(b)}$ at second solid Sb, which is greater than force ($_{\gamma LV(a)}$) counter to the flow direction of liquid L on first solid Sa on which liquid L has been passed. Thus, rush-delaying force ($F_d$), in other words, restraining force, occurs at liquid L. Here, rush-delaying force ($F_d$) is $$F_d=(\gamma_{SL(b)}+\gamma_{LV(a)}\times_{cos}\theta)-\gamma_{SV(a)}.$$

As a result of rush-delaying force ($F_d$) acting on liquid L as the restrain control function achieved by the difference between contact angles θa, θb, rushing of liquid L is restrained.

Specifically, firstly, liquid 5 introduced from liquid inlet 7*a* near the left end in FIGS. 1A and 1F into groove 3 is firstly brought into contact with the exposed surface at inner surface 2*a* of cover 2 at through hole 4*b*-5.

Subsequently, as liquid 5 starts flowing toward liquid outlet 7*b* in groove 3 while being in contact with the exposed surface at inner surface 2*a* of cover 2, liquid 5 is brought into contact with film segment 4*a*-4 adjacent to through hole 4*b*-5, around the center in FIGS. 1A and 1F.

Subsequently, as liquid 5 further flows in groove 3, liquid 5 is brought into contact with the exposed surface at inner surface 2*a* of cover 2 at through hole 4*b*-4 adjacent to film segment 4*a*-4.

Here, since contact angle θb at the exposed surfaces at inner surface 2*a* of cover 2 is greater than contact angle θa at film segments 4*a*, when liquid 5 having been flowing while being in contact with film segment 4*a* is brought into contact with the exposed surface at inner surface 2*a* of cover 2, at the boundary of film segment 4*a* and the exposed surface of inner surface 2*a* of cover 2, as described above, rush-delaying force ($F_d$) functions as the restraining force. That is, the restrain control function achieved by the difference between contact angles θa, θb acts on liquid 5. As a result, rushing of liquid 5 is restrained, and liquid 5 flows in the state where the distance between the leading end of main-flow liquid 5*b* and that of rushing liquid 5*a* is smaller (than in Conventional Example which will be described later).

In this manner, by liquid 5 flowing in groove 3 from liquid inlet 7*a* toward liquid outlet 7*b* while alternately brought into contact with film segments 4*a* of film 4 and the exposed surfaces at inner surface 2*a* of cover 2, rush-delaying force ($F_d$) acts on liquid 5 as the restrain control function achieved by the difference between contact angles θa, θb every time the material in contact with liquid 5 changes. Thus, rushing of liquid 5 is effectively restrained. As a result, liquid 5 can be supplied by a stable amount. The detailed reason thereof will be described later.

As mentioned above, the contact angle θa of each belt 4*a* is smaller than the contact angleθb of the part of the inward surface 2*a* on which the belt 4*a* is not provided.

Note that, taking into consideration of soil on the surface of the film, the difference between the contact angles of at least 20 degrees can generate the restraining force on liquid 5.

Comparative Example

Figure 3A:
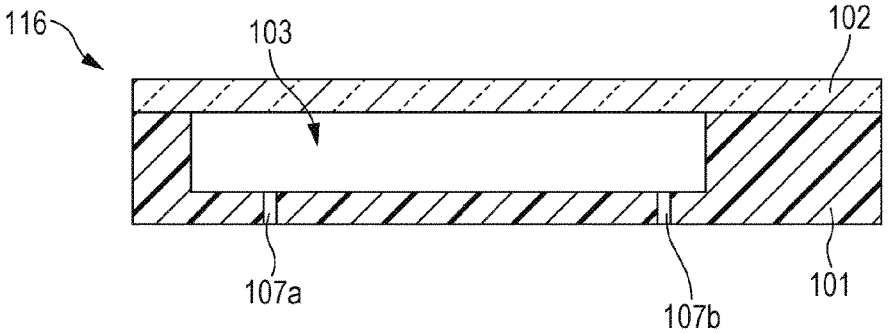
FIG. 3A is a side cross-sectional view of a microchip according to Conventional Example.
Figure 3B:
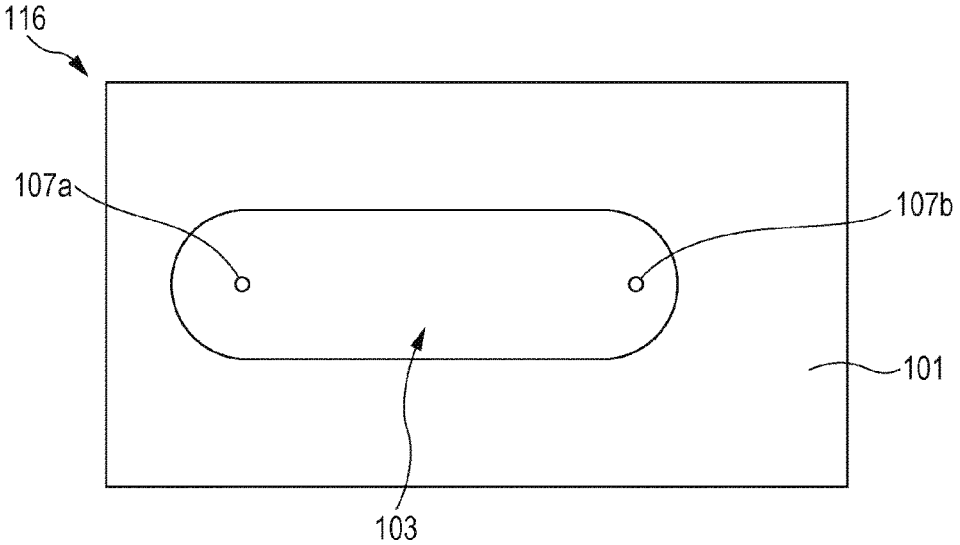
FIG. 3B is a plan view of the microchip according to Conventional Example in the state where a cover is removed.

FIGS. 3A and 3B show a side cross-sectional view of microchip 116 according to Conventional Example without film 4 as Comparative Example for describing an occurrence of a capillarity-related problem, and a plan view thereof in the state where cover 102 is removed.

Figure 4A:
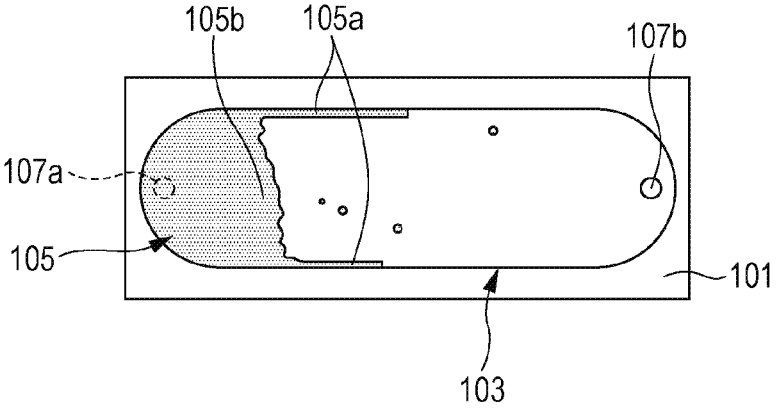
FIG. 4A is a plan view of the microchip according to Conventional Example in the state where the cover is removed, showing flows of a liquid preceding a main flow due to capillarity.
Figure 4B:
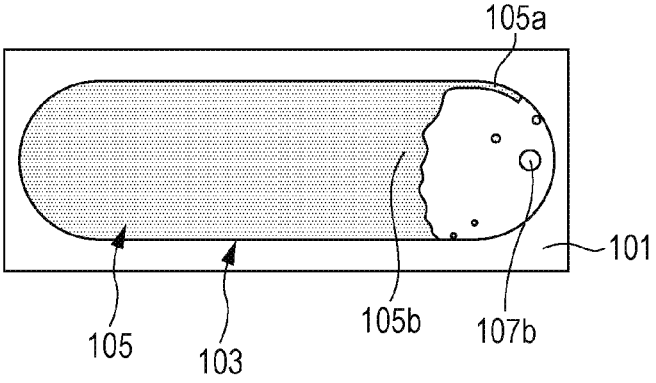
FIG. 4B is a plan view of the microchip according to Conventional Example in the state where the cover is removed, showing the flows of the liquid preceding the main flow due to capillarity.
Figure 4C:
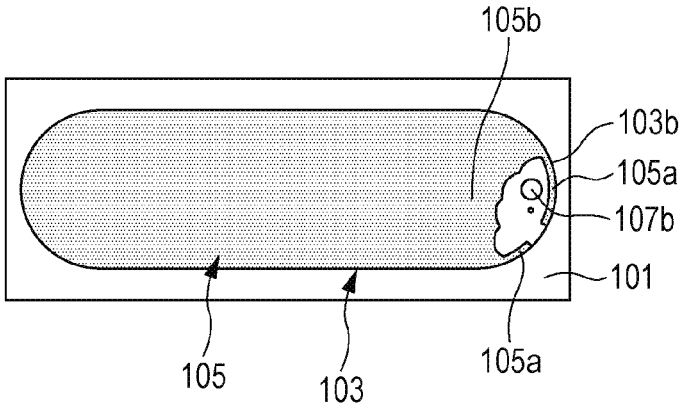
FIG. 4C is a plan view of the microchip according to Conventional Example in the state where the cover is removed, showing the flows of the liquid preceding the main flow due to capillarity.
Figure 4D:
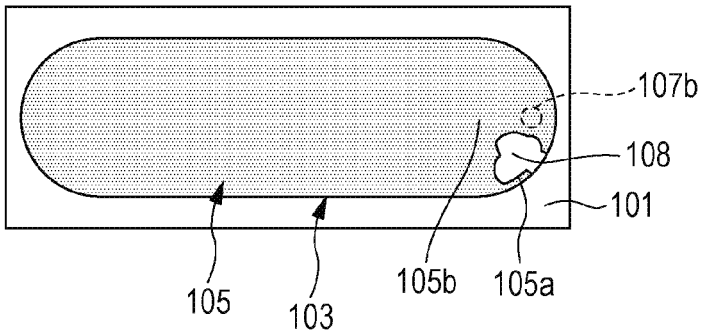
FIG. 4D is a plan view of the microchip according to Conventional Example in the state where the cover is removed, showing the flows of the liquid preceding the main flow due to capillarity.

With microchip 116 according to Comparative Example, in the case where liquid 105 is introduced from inlet 107*a* into groove 103 using a pump or the like, as shown in FIGS. 4A to 4D, capillarity is invited by a minor clearance between cover 102 and base 101 having groove 103. Thus, rushing liquid 105*a* of liquid 105 occurs. Note that, for the sake of clarity, liquid 105 is shaded in FIGS. 4A to 4D and the following drawings. Specifically, as shown in FIGS. 4A and 4B, at the minor clearances at the corners of groove 103 in the width direction where base 101 and cover 102 are bonded to each other, due to capillarity, a pair of flows of narrow rushing liquid 105*a* being part of liquid 105 flows in the liquid flow direction along the corners of groove 103, preceding main-flow liquid 105*b*. Further, as shown in FIG. 4C, just one rushing liquid 105*a* out of the pair of flows of rushing liquid 105*a* of liquid 105 reaches curved groove end wall 103*b* on the back side of liquid outlet 7*b* from one side preceding main-flow liquid 105*b*, to surround liquid outlet 7*b*. Then, main-flow liquid 105*b* together with the one rushing liquid 105*a* out of the pair of flows of rushing liquid 105*a* approaches liquid outlet 7*b* from one side (for example, from the top side in FIG. 4C), and enters liquid outlet 7*b*. Accordingly, as shown in FIG. 4D, air bubble 108 near liquid outlet 7*b* is pushed to the other side of liquid outlet 7*b* (for example, to the bottom side in FIG. 4C). Thus, when main-flow liquid 105*b* reaches liquid outlet 7*b*, the entire air bubble 108 is not drawn into liquid outlet 7*b*, and part of air bubble 108 being pushed away remains near liquid outlet 7*b*. As a result, because of this remaining air bubble 108, liquid 105 cannot be supplied by a stable amount.

As described hereinafter, microchip 6 according to the first exemplary embodiment exerts the restraining force on such rushing liquid 105*a*, and solves the disadvantageous remaining of an air bubble.

First Example of First Exemplary Embodiment

Microchip 6 actually fabricated as First Example of the first exemplary embodiment has the structure identical to that shown in FIGS. 1A to 1F, except that liquid inlet 7*a* and liquid outlet 7*b* are each disposed near the wall surface of groove 3 and film segment 4*a*-1 is omitted.

Figure 5A:
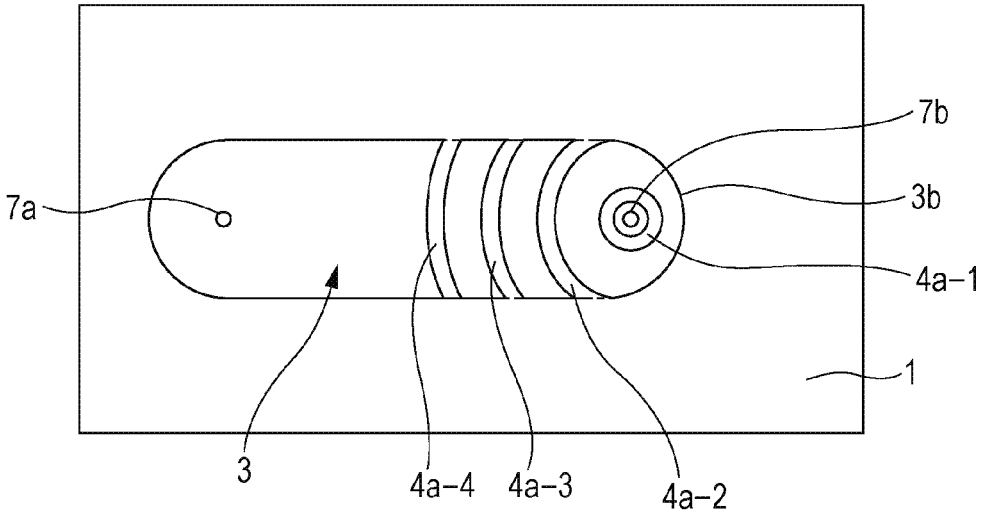
FIG. 5A is a plan view of the microchip according to the first exemplary embodiment in the state where the cover is removed.
Figure 5B:
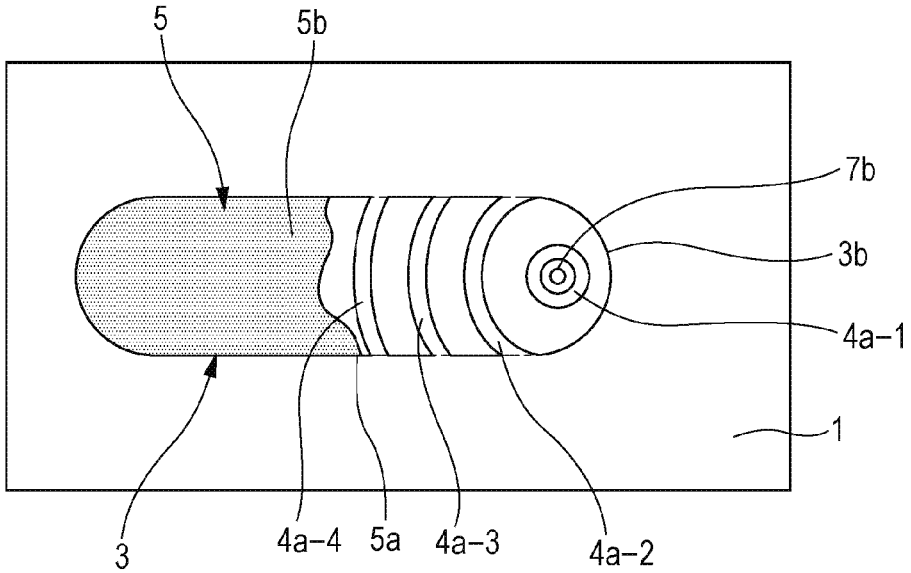
FIG. 5B is a plan view of the microchip according to the first exemplary embodiment in the state where the cover is removed, showing the flow of the liquid.

With such a structure, as shown in FIGS. 5A and 5B, at the minor clearances at the corners of groove 3 in the width direction where base 1 and cover 2 are bonded to each other, due to capillarity, narrow rushing liquid 5*a* being part of liquid 5 tends to flow in the liquid flow direction along the corners of groove 3, preceding main-flow liquid 5*b*.

Figure 5C:
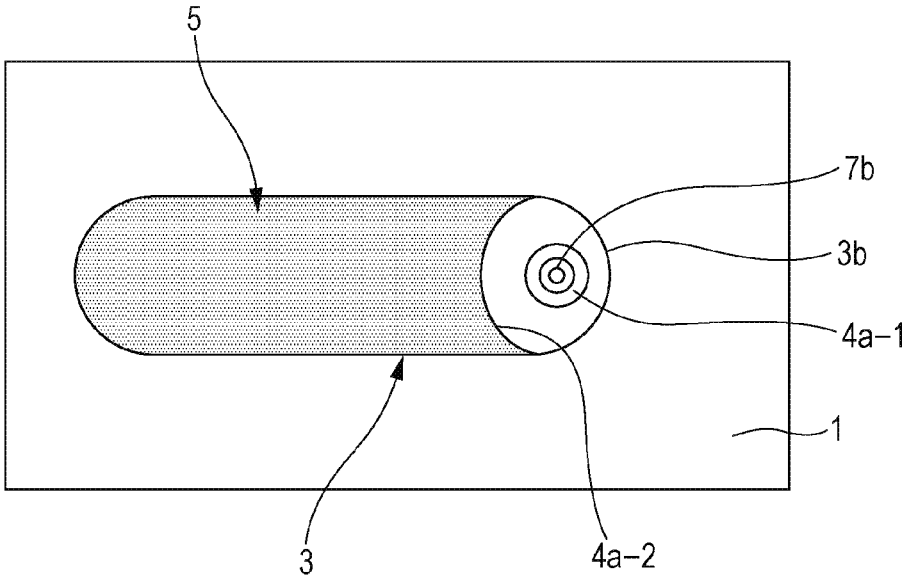
FIG. 5C is a plan view of the microchip according to the first exemplary embodiment in the state where the cover is removed, showing the flow of the liquid.

However, as shown in FIG. 5C, as described above, arc-band-like film segment 4*a*-4, film segment 4*a*-3, and film segment 4*a*-2 exerts the restraining force on rushing liquid 5*a* of liquid 5, whereby rushing liquid 5*a* becomes almost extinct. Thus, liquid 5 flows toward liquid outlet 7*b* while the leading end of main-flow liquid 5*b* is becoming arc-shaped concentrically to center 7*c* of liquid outlet 7*b*.

Figure 5D:
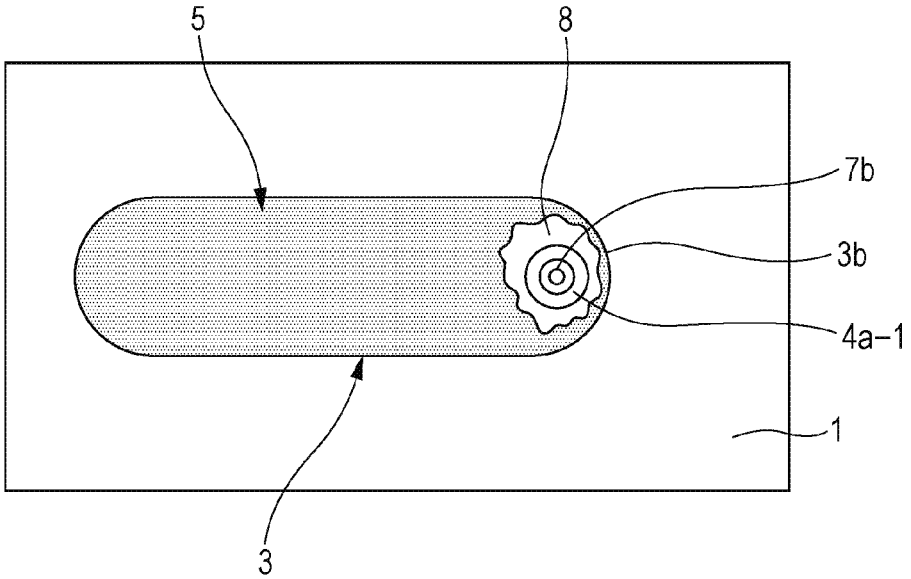
FIG. 5D is a plan view of the microchip according to the first exemplary embodiment in the state where the cover is removed, showing the flow of the liquid.
Figure 5E:
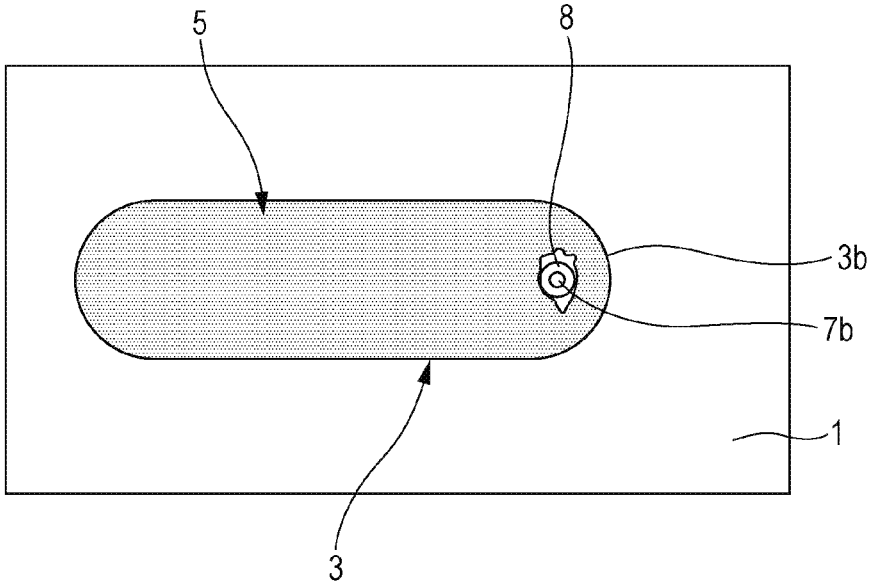
FIG. 5E is a plan view of the microchip according to the first exemplary embodiment in the state where the cover is removed, showing the flow of the liquid.
Figure 5F:
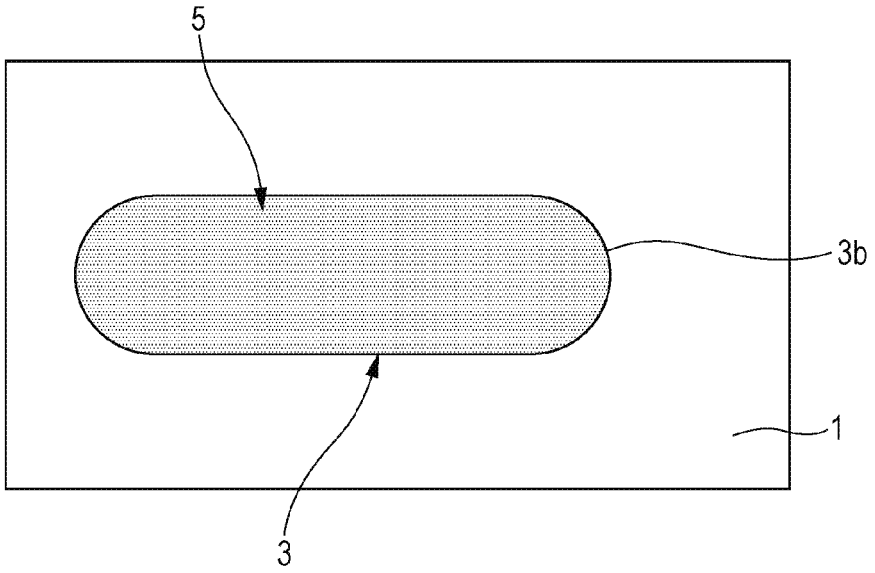
FIG. 5F is a plan view of the microchip according to the first exemplary embodiment in the state where the cover is removed, showing the flow of the liquid.

As a result, as shown in FIGS. 5D to 5F, the opposite ends of main-flow liquid 5*b* simultaneously reach curved groove end wall 3*b* on the back side of liquid outlet 7*b* and surround liquid outlet 7*b* from the opposite sides along curved groove end wall 3*b*. Then, liquid 5 encloses remaining air 8 in groove 3 about liquid outlet 7*b*, thereby smoothly sending air 8 into liquid outlet 7*b*. In this manner, liquid 5 can concentrate the entire air bubble 8 in groove 3, such as air, around liquid outlet 7*b* without leaving any air bubble 8 in groove 3, and thereafter send air bubble 8 into liquid outlet 7*b*. As a result, since air bubble 8 is eliminated from groove 3, liquid 5 can be supplied by a stable amount.

Effect Verification Experiment of First Example

In order to verify the effect of First Example, Comparative Example not provided with film 4 and First Example were created by thermal fluid analysis software "Particleworks" (a computational fluid dynamics software product available from Prometech Software, Inc.) based on the moving particle simulation (MPS) method, and a simulation was carried out.

In the simulation, verification was performed with Comparative Example having the structure shown in FIGS. 3A and 3B, and First Example having the structure shown in FIGS. 1A to 1F.

Groove 103, 3 formed at base 1 has a width of 5 mm, a length, which is the maximum dimension thereof, of 15 mm, and a depth of 0.28 mm. Each side measuring 5 mm being the minimum dimension of groove 3 (that is, each of the curved sides on the opposite ends of groove 3 in FIG. 3B) is rounded to have a radius of 2.5 mm. The liquid inlet and liquid outlet 107*a*, 107*b*, 7*a*, 7*b* through which liquid 105, 5 is introduced and discharged are each a hole having a radius of 0.1 mm. The distance between respective centers of liquid inlet 107*a*, 7*a*, and liquid outlet 107*b*, 7*b* is 13 mm. Further, cover 102, 2 is disposed so as to cover groove 103, 3 formed at base 101, 1.

In the conventional method, no film is formed on the surface of cover 102. Meanwhile, in First Example, on cover 2, film 4 is formed by a thickness of 5 μm and patterned to have a plurality of film segments 4*a* having a different contact angle at the exposed surfaces at inner surface 2*a* of cover 2. A comparative experiment was carried out with two types of such structures, namely, Comparative Example and First Example.

In the structure of First Example, film segments 4*a* of film 4 each differing from cover 2 in the contact angle are formed through patterning. Film segments 4*a* are each formed in an annular or arc-band-like shape about center-corresponding position 2*c*. The width of each annular and arc-band-like film segments 4*a* (the dimension in the radius direction) is 1.0 mm, and a thickness thereof is 15 μm. Portion 4*c* of film 4 which is in contact with base 1 and not corresponding to groove 3 is left intact.

The simulation was carried out assuming that: liquid 105, 5 was introduced from liquid inlet 107*a*, 7*a* at a flow rate of 11.9 (μl/sec) assuming polycarbonate resin which is the actually used material; the contact angle of groove 3 formed at base 1 was 75 degrees; the contact angle of cover 2 was also 75 degrees; and the contact angle of film 4 was 27 degrees assuming that film 4 was made of amorphous silicon or the like.

Result of Effect Verification Experiment

FIGS. 6A to 6G show the result of the simulation in which liquid 105 is introduced into groove 103 of microchip 116 having the conventional structure.

Figure 6A:
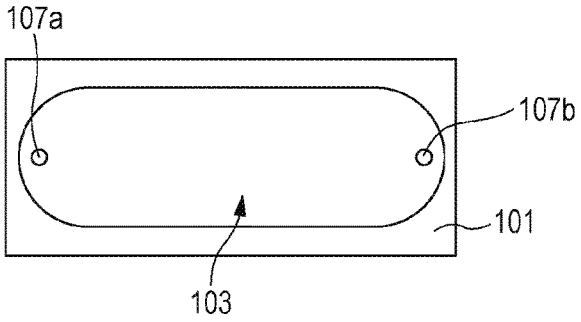
FIG. 6A is a plan view showing the shape of a groove of a microchip according to Conventional Comparative Example with which a simulation was performed.
Figure 6B:
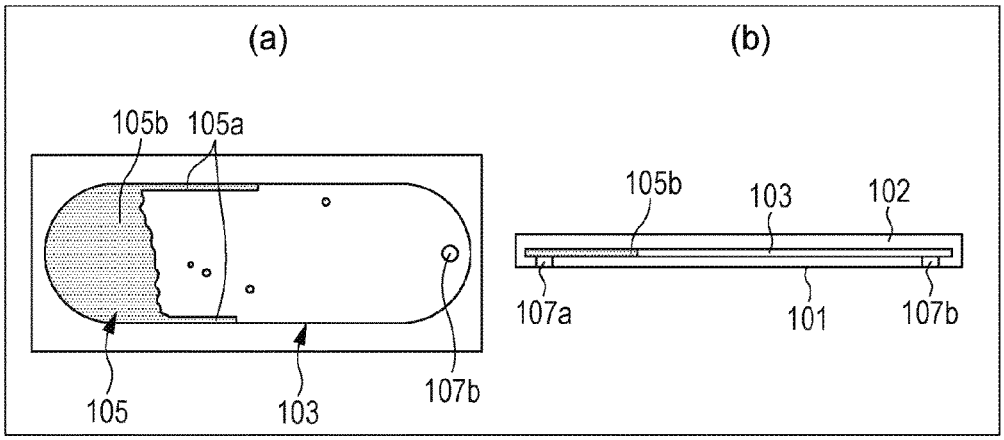
FIG. 6B is an explanatory diagram showing flows of a liquid in the simulation using the microchip according to Conventional Comparative Example.
Figure 6C:
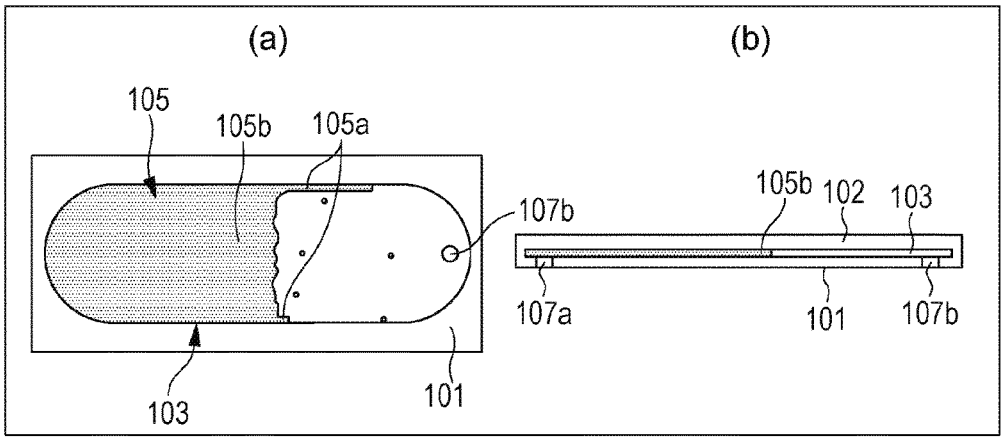
FIG. 6C is an explanatory diagram showing the flows of the liquid in the simulation using the microchip according to Conventional Comparative Example.
Figure 6D:
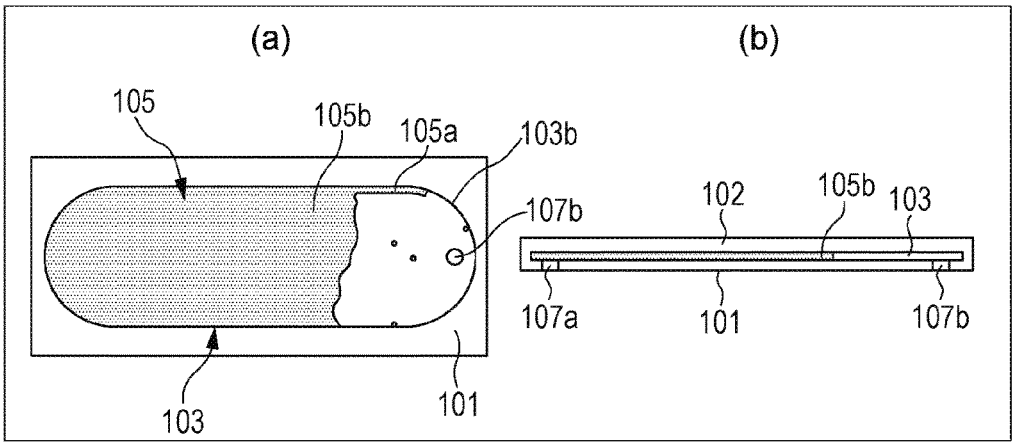
FIG. 6D is an explanatory diagram showing the flows of the liquid in the simulation using the microchip according to Conventional Comparative Example.
Figure 6E:
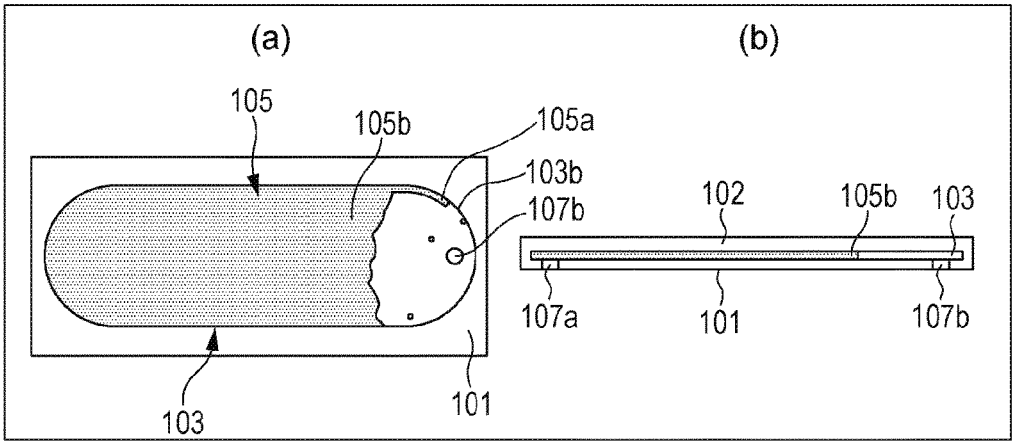
FIG. 6E is an explanatory diagram showing the flows of the liquid in the simulation using the microchip according to Conventional Comparative Example.
Figure 6F:
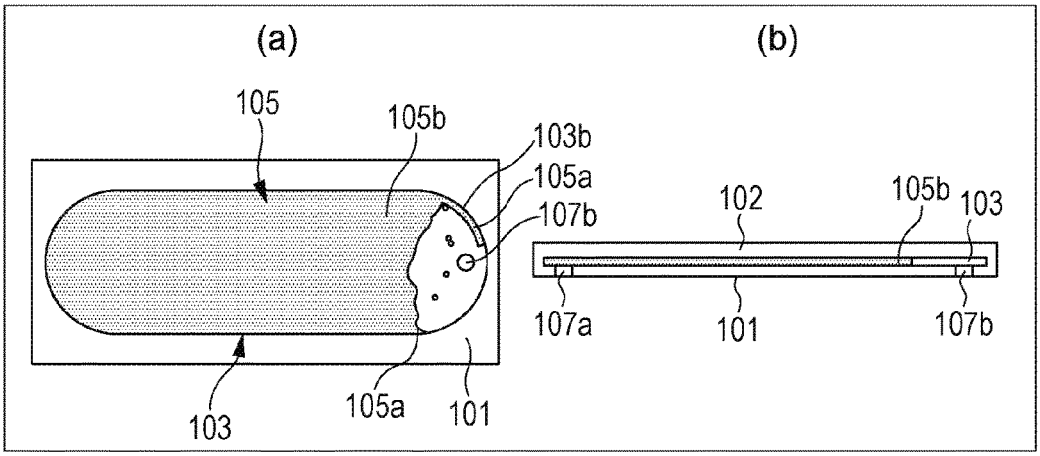
FIG. 6F is an explanatory diagram showing the flows of the liquid in the simulation using the microchip according to Conventional Comparative Example.
Figure 6G:
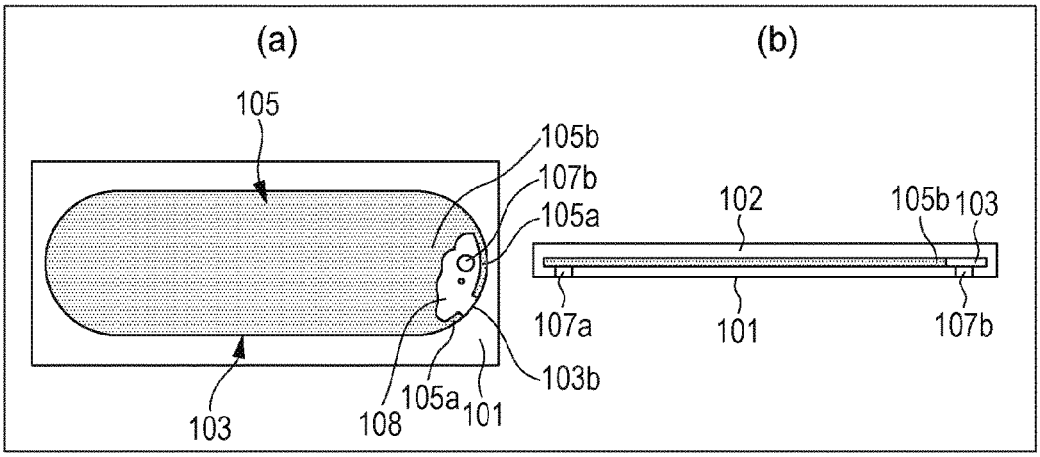
FIG. 6G is an explanatory diagram showing the flows of the liquid in the simulation using the microchip according to Conventional Comparative Example.

FIG. 6A shows the state before liquid 105 is introduced into groove 103 from liquid inlet 107*a*. FIGS. 6B to 6G sequentially show the manner of groove 103 being filled with liquid 105 introduced from liquid inlet 107*a* with the passage of time. FIGS. 6B to 6G each show a plan view (a) of groove 103 as seen from above and a side cross-sectional view (b) as seen from the side. As shown in FIGS. 6B to 6D, out of a pair of flows of rushing liquid 105*a* being the opposite leading portions of liquid 105, one rushing liquid 105*a* flowed earlier than other rushing liquid 105*a*, that is, liquid 105 was introduced at non-uniform introduction speed. Further, as shown in FIG. 6E, it was monitored that, at back side wall 103*b* of groove 103, rushing liquid 105*a* of liquid 105 advanced so as to surround liquid outlet 107*b* due to capillarity. FIG. 6F shows that one rushing liquid 105*a* of liquid 105 (for example, the upper one in FIG. 6F) approached liquid outlet 107*b* preceding other rushing liquid 105*a* (for example, the lower one in FIG. 6F). As this state was exacerbated, as shown in FIG. 6G, main-flow liquid 105*b* of liquid 105 reached liquid outlet 107*b* while air bubble 108 was left on one side of liquid outlet 107*b* (for example, on the lower side in FIG. 6F). This air bubble 108 remained in groove 103.

Meanwhile, FIGS. 7A to 7G show the result of the simulation in which liquid 5 is introduced into groove 3 of microchip 6 being First Example.

Figure 7A:
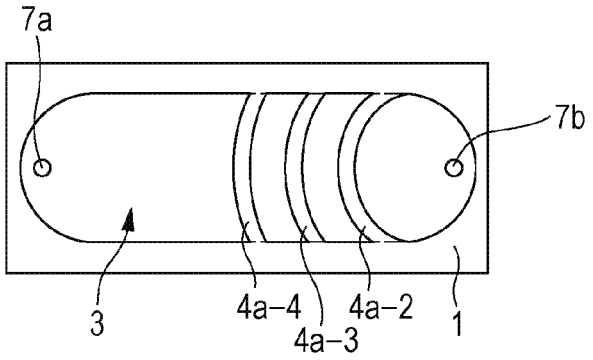
FIG. 7A is a plan view showing the shape of a groove of a microchip according to First Example with which a simulation was performed.

FIG. 7A shows the state before liquid 5 is introduced into groove 3 from liquid inlet 107*a*. FIGS. 7B to 7G sequentially show the manner of groove 3 being filled with liquid 5 introduced from liquid inlet 107*a* with the passage of time. FIGS. 7B to 7G each show a plan view (a) of groove 3 as seen from above and a side cross-sectional view (b) as seen from the side.

Figure 7B:
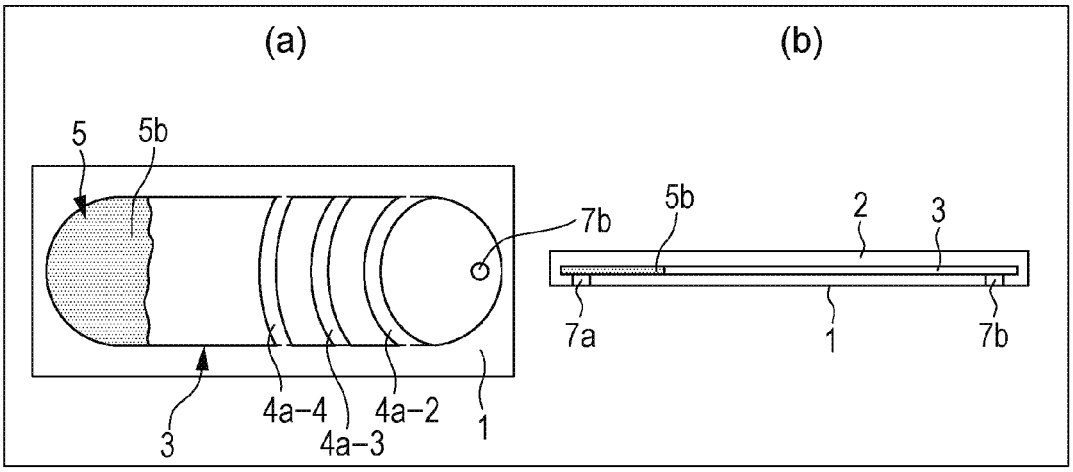
FIG. 7B is an explanatory diagram showing a flow of a liquid in the simulation using the microchip according to First Example.

As shown in FIG. 7B, due to capillarity, out of a pair of flows of rushing liquid 5*a* being the opposite leading portions of liquid 5, one rushing liquid 5*a* started to flow earlier than other rushing liquid 5*a*, and liquid 5 started to advance non-uniformly.

Figure 7C:
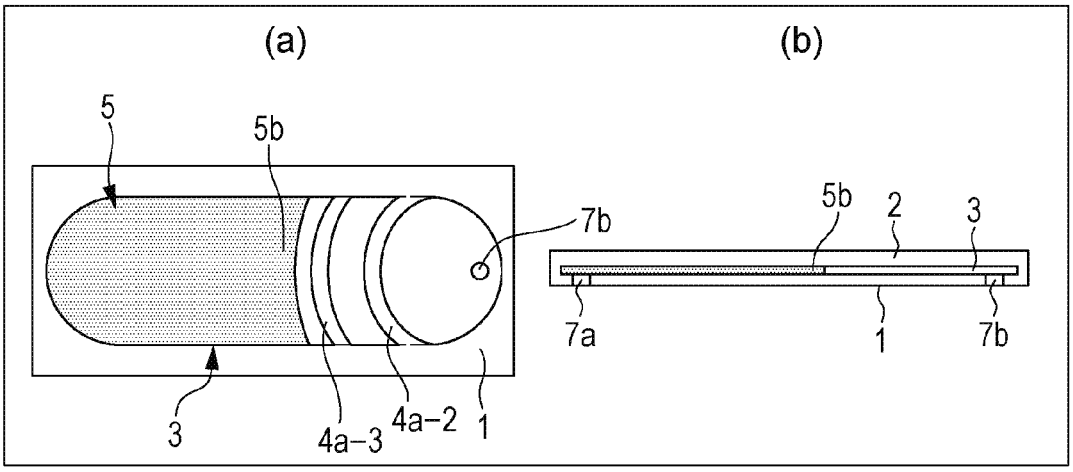
FIG. 7C is an explanatory diagram showing the flow of the liquid in the simulation using the microchip according to First Example.

However, as shown in FIG. 7C, when rushing liquid 5*a* was brought into contact with greatest arc-band-like film segment 4*a*-4 of film 4 having a different contact angle, the speed was restrained and the leading end of main-flow liquid 5*b* was once aligned with the patterned arc-shape of arc-band-like film segment 4*a*-4.

Figure 7D:
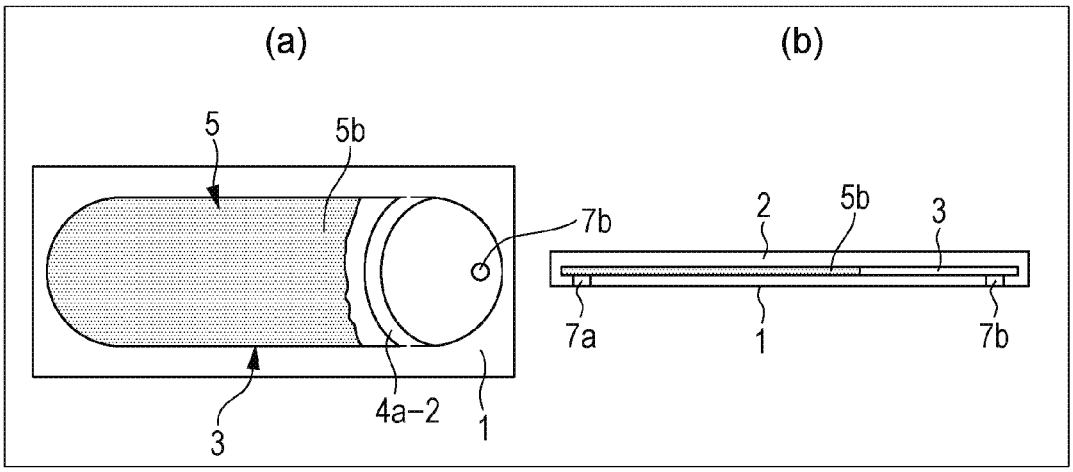
FIG. 7D is an explanatory diagram showing the flow of the liquid in the simulation using the microchip according to First Example.

Further, when liquid 5 was continuously introduced, as shown in FIG. 7D, the leading end of main-flow liquid 5*b* was further once aligned with second greatest arc-band-like film segment 4*a*-3 of film 4 having a different contact angle.

Figure 7E:
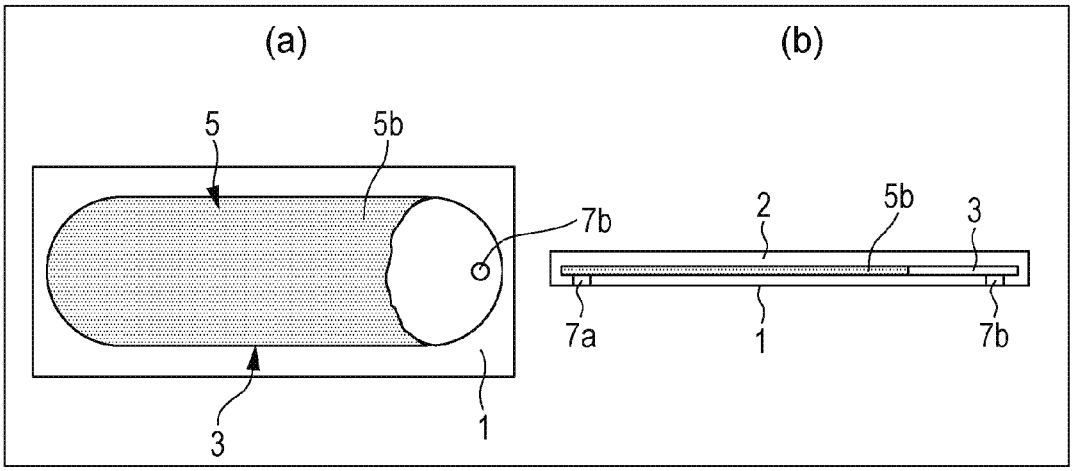
FIG. 7E is an explanatory diagram showing the flow of the liquid in the simulation using the microchip according to First Example.

Thereafter, as shown in FIG. 7E, the leading end of main-flow liquid 5*b* was again once aligned with third greatest arc-band-like film segment 4*a*-2 of film 4 having a different contact angle.

In this manner, as shown in FIGS. 7B to 7E, since a plurality of film segments 4*a* of film 4 differing in the contact angle are formed through patterning on cover 2, rushing liquid 5*a* of advancing liquid 5 could be prevented from advancing.

Figure 7F:
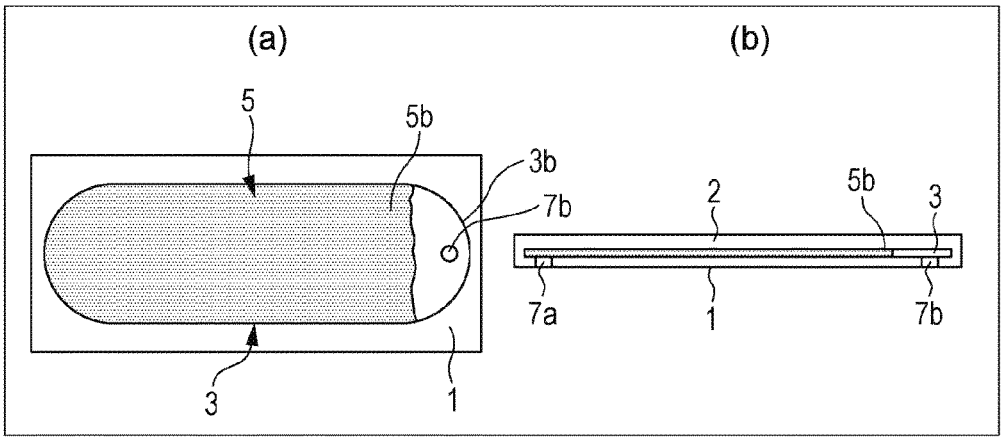
FIG. 7F is an explanatory diagram showing the flow of the liquid in the simulation using the microchip according to First Example.

Thereafter, as shown in FIG. 7F, without being preceded by flows of rushing liquid 5*a* on the opposite sides, the leading end of main-flow liquid 5*b* uniformly advanced toward liquid outlet 7*b*.

Figure 7G:
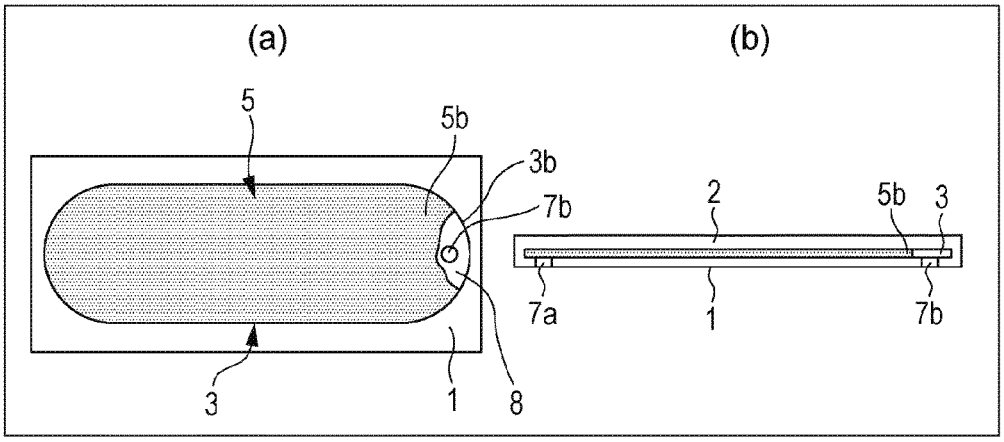
FIG. 7G is an explanatory diagram showing the flow of the liquid in the simulation using the microchip according to First Example.

Finally, as shown in FIG. 7G, the opposite sides of main-flow liquid 5*b* simultaneously reached curved groove end wall 3*b* on the back side of liquid outlet 7*b*, and surrounded liquid outlet 7*b* from the opposite sides along curved groove end wall 3*b*. As a result, liquid 5 enclosed remaining air 8 in groove 3 about liquid outlet 7*b*, thereby smoothly sending air 8 into liquid outlet 7*b*. Hence, liquid 5 could concentrate the entire air bubble 8 in groove 3, such as air, around liquid outlet 7*b* without leaving any air bubble 8 in groove 3, and thereafter send air bubble 8 into liquid outlet 7*b*.

From the result of the experiment, with First Example, it was learned that groove 3 could be filled with liquid 5 by a stable supply amount because air bubble 8 was eliminated from groove 3. That is, it was learned that, by forming film 4 having a different contact angle on cover 2 and thereafter forming arc-band-like film segments 4*a*, liquid 5 could be efficiently discharged to liquid outlet 7*b* without air bubble 8 being remained in groove 3.

According to the first exemplary embodiment, arc-shaped curved-band-like film segments 4*a* each having a radius about the center of liquid outlet 7*b* of groove 3 and the inner surface 2*a* of cover 2 are alternately disposed, the inner surface and film segments being different from each other in the contact angle. Thus, the restraining force is exerted on rushing liquid 5*a* when liquid 5 is introduced, and air bubble 8 in groove 3 can be expelled from liquid outlet 7*b* by liquid 5 surrounding liquid outlet 7*b*. As a result, liquid 5 can be supplied by a stable amount.

Hence, even in the situation where flows of rushing liquid 5*a* on the opposite sides in the width direction of liquid 5 introduced into groove 3 from liquid inlet 7*a* are initially preceding main-flow liquid 5*b* toward liquid outlet 7*b*, film segments 4*a* can exert the restraining force to align the leading end of liquid 5. Thus, groove 3 can be filled with liquid 5 while maintaining the distance from the leading end of liquid 5 to liquid outlet 7*b* to substantially uniform. By film segments 4*a* being disposed near liquid outlet 7*b* of liquid 5, advancement of liquid 5 and the portion to be filled with can be controlled, whereby air bubble 8 can be restrained from remaining in groove 3.

Second Exemplary Embodiment

FIGS. 8A to 8D are a side cross-sectional view of microchip 6B according to a second exemplary embodiment of the present disclosure, a plan view thereof as seen from above, a side cross-sectional view of a cover, and a plan view of the cover as seen from above.

As shown in FIGS. 8A to 8D, microchip 6B is different from microchip 6 according to the first exemplary embodiment in that a plurality of film segments are fixed to inner surface 2*a* of cover 2 independently of each other, instead of being integrated as a single film.

Specifically, on inner surface 2*a* of cover 2, film 4 being different in the contact angle from the exposed surface at inner surface 2*a* of cover 2 is formed. Thereafter, film 4 is patterned through a lithography process or the like, such that only arc-band-like film segments 4*a*, in other words, annular or arc-band-like thin film segments 4*a*, are left.

Figure 8A:
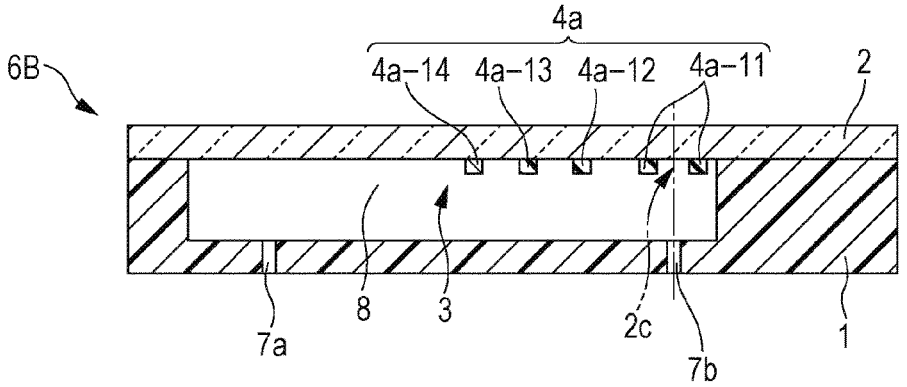
FIG. 8A is a side cross-sectional view of a chamber of a microchip according to a second exemplary embodiment of the present disclosure.
Figure 8B:
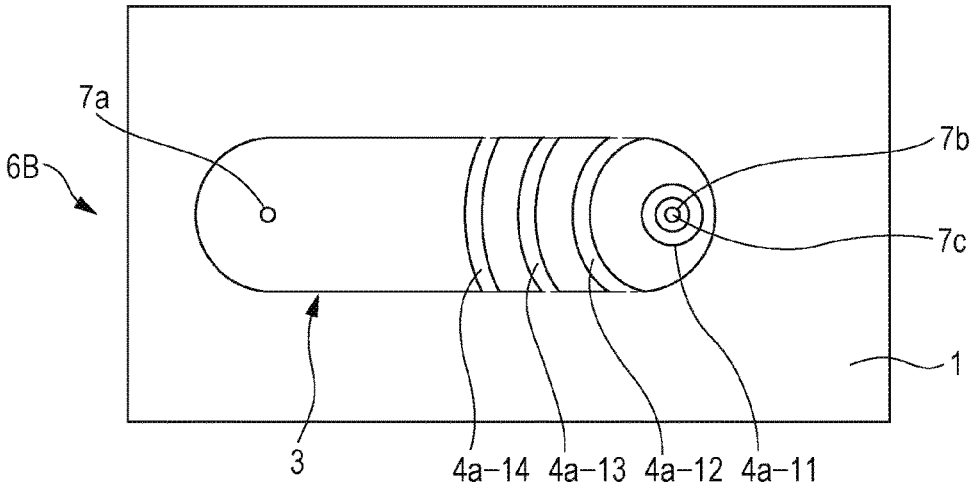
FIG. 8B is a plan view of the microchip according to the second exemplary embodiment of the present disclosure in the state where a cover is removed.
Figure 8C:
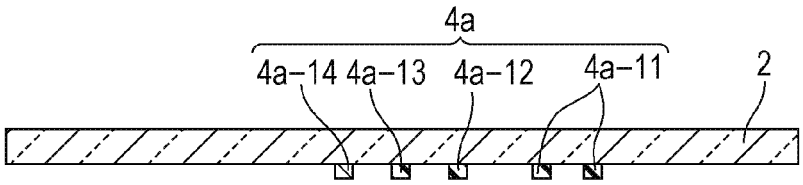
FIG. 8C is a side cross-sectional view of the cover of the microchip according to the second exemplary embodiment of the present disclosure.
Figure 8D:
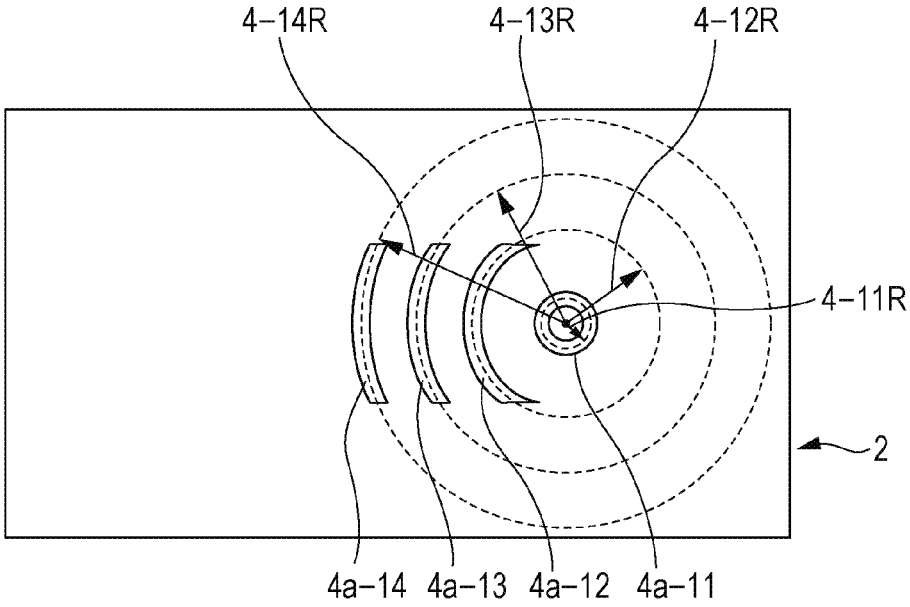
FIG. 8D is a perspective plan view of the cover of the microchip according to the second exemplary embodiment of the present disclosure.

As shown in FIGS. 8B and 8D, as a result of the patterning, annular or arc-band-like shapes about center-corresponding position 2*c* of cover 2 corresponding to the center of liquid outlet 7*b* are formed.

FIGS. 8B and 8D show annular film segment 4*a*-11 that has smallest radius 4-11R from center-corresponding position 2*c*. FIGS. 8B and 8D further show arc-band-like film segment 4*a*-12 that is patterned to have greater radius 4-12R from center-corresponding position 2*c*. FIGS. 8B and 8D further show film segment 4*a*-13 patterned to have further greater radius 4-13R and film segment 4*a*-14 patterned to have still further greater radius 4-14R in order. Here, as to the positional relationship between base 1 and cover 2, base 1 side is the bottom side, and cover 2 side is the top side. Further, in an actual experiment, the arc width (the dimension in the radius direction) of each of film segments 4*a*-2, 4*a*-3, 4*a*-4 is set to 1.0 mm. Film 4 formed on cover 2 is removed by patterning except for film segments 4*a* corresponding to groove 3, and base 1 and cover 2 are directly bonded to each other to structure microchip 6B. Since the film segments formed on cover 2 are not brought into contact with base 1, base 1 and cover 2 are directly bonded to each other without any unevenness. Thus, leakage of liquid 5 introduced into groove 3 is advantageously prevented.

However, practically, cover 2 having a plurality of concentric arc-shaped film segments 4*a*-2, 4*a*-3, 4*a*-4 as shown in FIG. 1F can be manufactured easier than the cover used in the experiment.

Note that, the present disclosure is not limited to the exemplary embodiments described above, and can be practiced in various other modes.

In the present specification and the scope of claims, the arc-shape of each of film segments 4*a* means a curved line or a polygonally bent line that passes through, out of positions in the edge of each film segment 4*a* along which the liquid flows, at least three points in total including the center and the opposite ends, the three points being equally distanced from center 7*c* of liquid outlet 7*b*.

Figure 9:
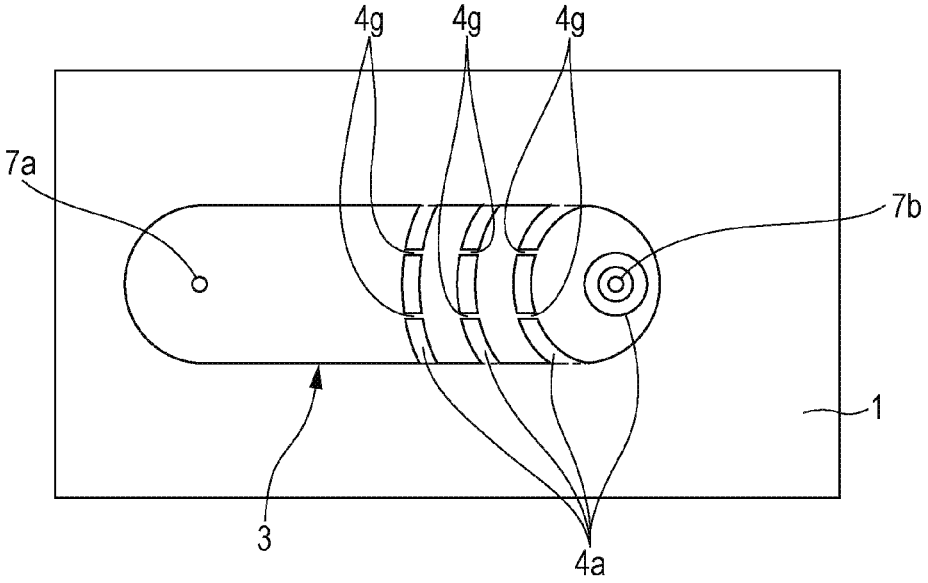
FIG. 9 is a plan view showing a microchip according to Variation of the exemplary embodiment of the present disclosure in the state where cover is removed.

For example, as shown in FIG. 9, the film segments are not limited to continuously extend, and may each be divided by slits extending along the flow direction of liquid 5. That is, slit 4*g* having a width as great as the thickness of film segments 4*a* may be formed at a central portion or the like where rushing liquid 5*a* is not easily brought into contact with. Such a structure is advantageous in that, since slit 4*g* is formed at a portion where the flow speed is locally low by the shape of groove 3, a portion where the flow speed is locally fast can be created, to solve the trouble at the portion where the flow speed is locally low. As shown in FIG. 9, the longitudinal direction of the slit 4*g* may be parallel to the longitudinal direction of the groove 3 (namely, to the flow direction of the liquid.

Note that, when the difference in the contact angle between the exposed surfaces at the inner surface 2*a* of cover 2 and film segments 4*a* is small, the restraining effect can be increased by an increase in the number of film segments 4*a*.

Note that, any appropriate combination of the various exemplary embodiments and Variations can achieve their respective effects. Further, a combination of exemplary embodiments, a combination of Examples, or a combination of an exemplary embodiment and Example is also effective. Further, a combination of characteristics in different exemplary embodiments or Examples is also effective.

With the microelement of the present disclosure, even in the situation where flows of rushing liquid on the opposite sides in the width direction of the liquid which is introduced from the liquid inlet and with which the groove is filled are initially preceding the main-flow liquid toward the liquid outlet, the film segments can exert the restraining force to align the leading end of the liquid. Thus, advancement of the liquid and the portion to be filled can be controlled, whereby any air bubble can be restrained from remaining in the groove. The microelement of the present disclosure is suitable as a microelement such as a microdevice or a microchip for handling liquid of several microliters to several hundred microliters per second.

The invention derived from the above disclosure will be listed below.

1. A microchip, comprising:

a plate-like base comprising an inlet, an outlet, and a groove through which a liquid flows from the inlet to the outlet; and a cover disposed opposite to the plate-like base;

wherein the cover has an inward surface and an outward surface;

the inward surface of the cover is opposite the plate-like base;

the inward surface of the cover is provided with a first belt having a thickness parallel to a thickness direction of the plate-like base in such a manner that the first belt is protruded from the inward surface toward a bottom surface of the groove;

the first belt has a shape of a minor arc;

a center of the minor arc of the first belt is located at the outlet; and a contact angle of the first belt is smaller than a contact angle of a part of the inward surface of the cover on which the first belt is not provided.

2. The microchip according to the item 1, wherein the inward surface of the cover is further provided with a second belt;

the second belt has a shape of a minor arc;

a minor arc of the minor arc of the second belt is located at the outlet;

a contact angle of the second belt is smaller than a contact angle of a part of the inward surface of the cover on which neither the first belt nor the second belt is provided; and the minor arc of the second belt has a larger radius than the minor arc of the first belt.

3. The microchip according to the item 1, wherein the difference between the contact angle of the first belt and the contact angle of the part of the inward surface of the cover on which the belt is not provided is not less than 20 degrees.

4. The microchip according to the item 1, wherein the first belt has a thickness of not less than 5 nanometers and not more than 14 micrometers.

5. The microchip according to the item 1, wherein the first belt has a slit; and a longitudinal direction of the slit is parallel to a longitudinal direction of the groove.

6. The microchip according to the item 1, wherein a backend wall is located at an end of the groove on a side of the outlet; and a radius of the minor arc of the first belt is larger than a distance between the outlet and the backend wall.

REFERENCE SIGNS LIST

1: base 1
2: cover
2*a*: inner surface of cover
2*c*: center-corresponding position of cover
3: groove
3*b*: back end wall
4: film
4*a*, 4*a*-1, 4*a*-2, 4*a*-3, 4*a*-4: film segment
4*b*, 4*b*-1, 4*b*-2, 4*b*-3, 4*b*-4, 4*b*-5: through hole
4*c*: portion except for groove and being in contact with base
4*g*: slit
5, 105: liquid
6, 6B: microchip
7*a*: liquid inlet
7*b*: liquid outlet
7*c*: center of liquid outlet
8: air bubble
105*a*: rushing liquid
105*b*: main-flow liquid
105*c*: outer rushing liquid
105*d*: inner rushing liquid

What is claimed is:

1. A microchip, comprising:

a plate-like base comprising an inlet, an outlet, and a groove through which a liquid flows from the inlet to the outlet; and a cover disposed opposite to the plate-like base;

wherein the cover has an inward surface and an outward surface;

the inward surface of the cover is opposite the plate-like base;

the inward surface of the cover is provided with a first belt having a thickness parallel to a thickness direction of the plate-like base in such a manner that the first belt is protruded from the inward surface toward a bottom surface of the groove;

the first belt has a shape of a minor arc;

a center of the minor arc of the first belt is located at the outlet; and a contact angle of the first belt is smaller than a contact angle of a part of the inward surface of the cover on which the first belt is not provided.

2. The microchip according to claim 1, wherein the inward surface of the cover is further provided with a second belt;

the second belt has a shape of a minor arc;

a minor arc of the minor arc of the second belt is located at the outlet;

a contact angle of the second belt is smaller than a contact angle of a part of the inward surface of the cover on which neither the first belt nor the second belt is provided; and the minor arc of the second belt has a larger radius than the minor arc of the first belt.

3. The microchip according to claim 1, wherein the difference between the contact angle of the first belt and the contact angle of the part of the inward surface of the cover on which the belt is not provided is not less than 20 degrees.

4. The microchip according to claim 1, wherein the first belt has a thickness of not less than 5 nanometers and not more than 14 micrometers.

5. The microchip according to claim 1, wherein the first belt has a slit; and a longitudinal direction of the slit is parallel to a longitudinal direction of the groove.

6. The microchip according to claim 1, wherein a backend wall is located at an end of the groove on a side of the outlet; and a radius of the minor arc of the first belt is larger than a distance between the outlet and the backend wall.

* * * * *